United States Patent [19]

Tobey

[11] 3,964,213

[45] June 22, 1976

[54] ABRASIVE CLEANING TOOL

[76] Inventor: Alton E. Tobey, 2203 Mission St., Santa Cruz, Calif. 95060

[22] Filed: Mar. 17, 1975

[21] Appl. No.: 559,328

[52] U.S. Cl. ..... 51/392; 51/404

[51] Int. Cl.[2] ..... B24D 15/04

[58] Field of Search ..... 51/391–393, 51/394–397, 293, 295, 296, 400, 404; 15/231, 232, 209 AH; 401/270–280, 137, 139, 42

[56] References Cited

UNITED STATES PATENTS

| | | | |
|---|---|---|---|
| 1,504,365 | 8/1924 | Mayhood | 15/231 |
| 2,589,531 | 3/1952 | Brooks | 51/391 |
| 3,225,497 | 12/1965 | Brandt | 51/358 |
| 3,377,123 | 4/1968 | Leeson | 401/139 |
| 3,495,359 | 2/1970 | Smith et al. | 51/209 R |
| 3,860,400 | 1/1975 | Prowse | 51/209 R |

FOREIGN PATENTS OR APPLICATIONS

| | | | |
|---|---|---|---|
| 779,358 | 7/1957 | United Kingdom | 51/404 |

*Primary Examiner*—Al Lawrence Smith
*Assistant Examiner*—Nicholas P. Godici
*Attorney, Agent, or Firm*—Theodore J. Bielen, Jr.; Richard Esty Peterson

[57] ABSTRACT

An abrasive cleaning tool for underwater cleaning of fouled hull bottoms, swimming pools and the like; the cleaning tool has a connecting arm for attachment to an elongated handle, a head assembly to which a contoured wire screen, coated with a particulate abrasive, is attached; the head assembly includes a supporting surface for the wire screen having ridge elements for displacing the screen from the supporting surface for flushing action on the screen during use.

10 Claims, 6 Drawing Figures

ABRASIVE CLEANING TOOL

BACKGROUND AND SUMMARY OF THE INVENTION

This invention relates to a cleaning tool and in particular to an abrasive cleaning tool for underwater cleaning of algae and crustacean fouling common to surfaces maintained underwater. Since the cleaning tool is abrasive in nature, the tool is most effective on surfaces not readily damaged, such as steel boat hulls, wood pilings, concrete swimming pools, outdoor ponds, and the like.

Structures which are maintained underwater for any length of time frequently become fouled with algae or other growths. Unchecked, they often become a nuisance and can lead to actual damage to the structure. The most effective manner of removing such growth is by mechanical brushing or scraping. However, brushing is not always sufficient to remove all of the unwanted growth because of the combing action of a brush. Scraping also is inadequate in many areas since scraping blades lack the necessary flexibility on coarse or irregular surfaces. The cleaning tool of the present invention utilizes a mesh screen coated with abrasive particles to provide a scraping type surface that has a degree of flexibility which allows coarse and irregular surfaces to be effectively cleaned. The mesh screen is mounted on a support assembly which allows a flushing action through the screen to prevent the screen from clogging. The support assembly is also adaptable to connection with a tubular handle through which water may be run to aid in the cleaning operation and the flushing of the screen.

These and other features will become apparent from the detailed description of the preferred embodiments.

DETAILED DESCRIPTION OF THE PREFERRED EMBODIMENTS

Figure 1:
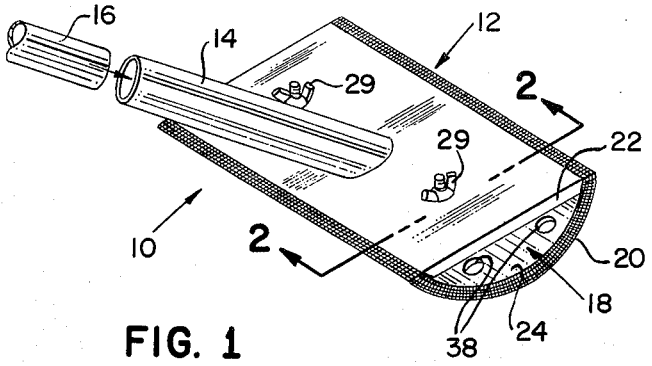
FIG. 1 is a perspective view of the principal embodiment of this abrasive cleaning tool.

Referring now to FIG. 1, the principal embodiment of the abrasive cleaning tool of this invention, designated generally by the reference numeral 10, is shown. The cleaning tool 10 includes a head assembly 12 rigidly connected to a hollow coupling arm 14. The coupling arm is, in turn, telescopically connectable to a tubular extension 16. The tubular extension 16 is optionally connectable to a water hose (not shown) for supplying running water to the head assembly 12 if desired.

Figure 2:
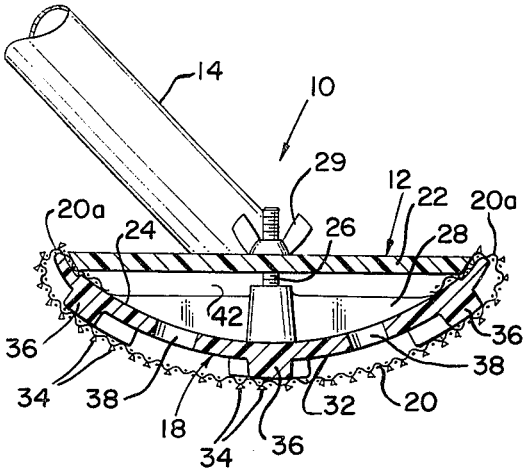
FIG. 2 is a cross-sectional view of the cleaning tool taken on the lines 2—2 in FIG. 1.

The head assembly 12 includes a contoured support assembly 18 to which is attached a wire mesh screen 20. The elements of the head assembly are shown in greater detail in FIGS. 2 and 3. Referring to FIG. 2, the support assembly includes a flat top plate 22 to which the coupling arm 14 is integrally fixed. A contoured backing plate 24 is fastened to the top plate by a pair of threaded stud bolts 26, which are fixed to two structural ribs 28 (one shown in FIG. 2) on the concave side of the contoured backing plate. Wing nuts 29 threadably engage the ends of the stud bolts 26 that project through holes 30 (shown in FIG. 3) in the top plate 22.

The wire mesh screen 20 is wrapped across the convex face 32 of the contoured backing plate, overlapped on opposite edges 20a along the edges of the contoured backing plate and secured by the clamping action of the backing plate against the top plate. The screen itself is covered with abrasive particles, preferably carbide. This is accomplished in a separate operation prior to assembly, as follows: a copper paste is applied to the surface of the screen; crushed carbide granules are sprinkled on the screen; an additional copper powder is then applied to protect the carbide granules; and the screen is then heat-dried and cut to size. The abrasive carbide granules 34 are visible in the cross-sectional view of FIG. 2.

Figure 3:
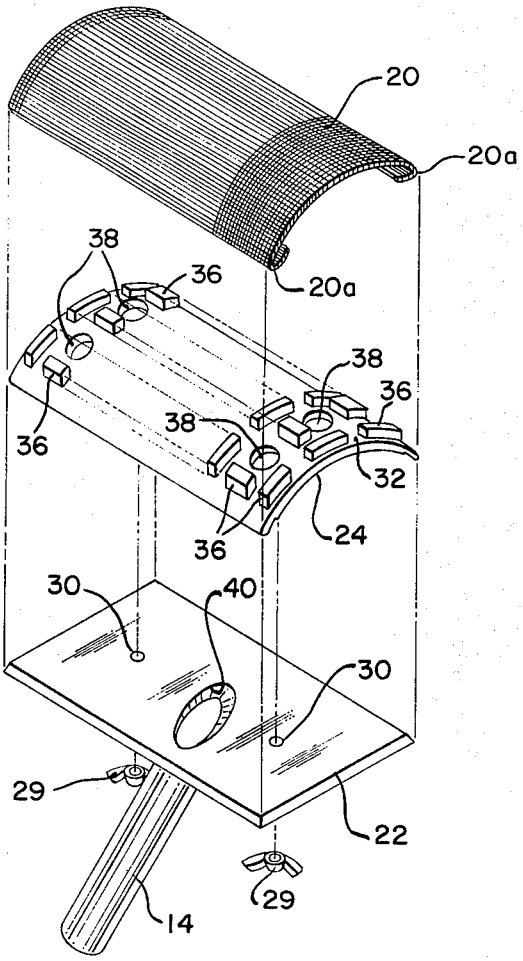
FIG. 3 is an exploded view of the cleaning tool of FIG. 1.

As shown most clearly in the exploded view of FIG. 3, the backing plate 24 has a plurality of ridges 36 projecting from the convex face 32 of the backing plate. The ridges 36 cause the wire mesh screen 20 to be displaced from the convex face 32 to allow a flushing action of the water to penetrate the screen and prevent any clogging buildup of algae or other matter during use. Since the cleaning tool is manually used in a conventional reciprocal manner, the motion during use agitates the water for flushing. This feature is enhanced by the inclusion of holes 38 which allow water to pass through the contoured plate.

Optionally, to increase the flushing action, running water can be delivered through the extension 16, the hollow connector arm 14, and through a hole 40 in the top plate to a chamber 42 formed between the top plate 22 and contoured backing plate 24.

Figure 4:
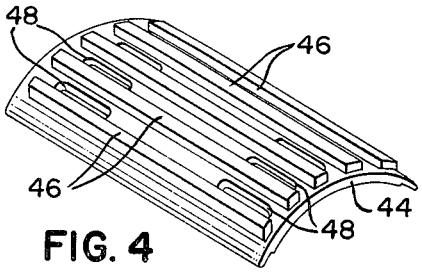
FIG. 4 is a perspective view of an alternate embodiment of the backing plate shown in the exploded view of FIG. 3.
Figure 5:
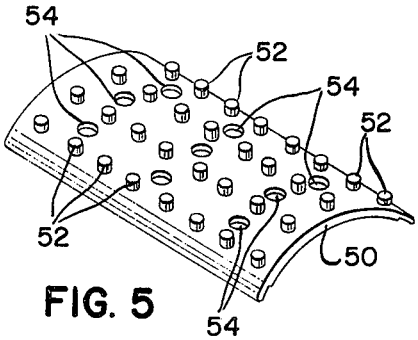
FIG. 5 is a perspective view of a further alternate embodiment of the backing plate shown in the exploded view of FIG. 3.

The configuration of the means for displacing the screen 20 from the backing plate 24 may be varied as shown in FIGS. 4 and 5. In FIG. 4, an alternate embodiment of a backing plate 44 is shown having a series of elongated ridges 46 running substantially the length of the plate. Holes 48 are also included to aid the flushing action permitted by the plate design. The plate may be substituted in the head assembly 12, shown in FIG. 1, without further alteration. Similarly, in FIG. 5, a second alternate embodiment of a backing plate 50 is shown having a plurality of studs 52 projecting from the plate. Again, a series of holes 54 is also included to enhance the flushing action of the plate. Other configurations may also be utilized with desired results and the embodiments shown are included merely to illustrate several exemplars which may be employed. While ridges and holes may be eliminated from the backing plate, the resultant tool loses some of its effectiveness because of clogging of the screen and is not preferred.

Figure 6:
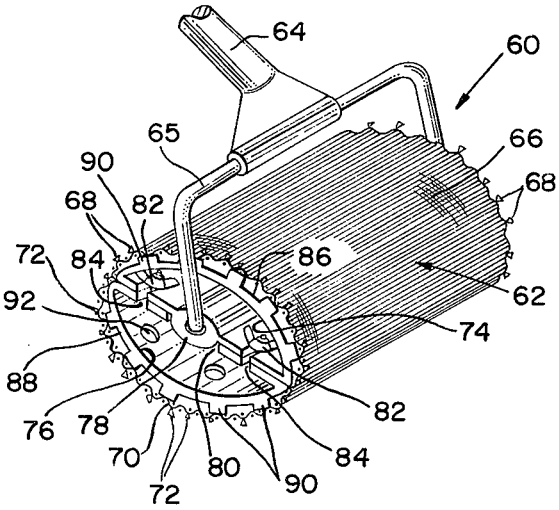
FIG. 6 is a perspective view of an alternate embodiment of the cleaning tool.

Referring now to FIG. 6, an alternate embodiment of the overall cleaning tool is shown. Designated generally by reference numeral 60, this cleaning tool includes a head assembly 62 that is pivotally connected to an elongated handle 64 (a portion of which is shown in FIG. 6) by a bracket 65. The head assembly 62 is designed to include two abrasive scouring surfaces which preferably are of different texture. For example, a wire mesh screen 66 having coarse carbide granules 68 is provided on the top of the head assembly and a wire mesh screen 70 having fine carbide granules 72 is provided on the bottom of the head assembly.

The head assembly 62 is constructed of two half moon shaped support sections 74 and 76 which are coupled together such that the edges of the mesh screens 66 and 70 are clamped between the interfaced support sections. The top support section 74 includes an integral tubular core 78 into which the ends of the connecting bracket 65 are journaled, thereby allowing the head assembly to be pivoted with respect to the handle during use or inverted for use of the opposite scouring screen.

The bottom support section 76 has a gap 80 on the flat portion of the support section to allow the tubular core to be centered between the two sections. The two sections are clamped together by bolt and wing nut fasteners 82 which are insertable in coincident slots 84 on the ends of the coupled support sections. The convex faces 86 and 88 of the two support sections are similar to the convex face 30 of the principal embodiment of FIG. 1 and include ridges 90 and holes 92 to allow the flushing action of the water during use to cleanse the screens.

The support assemblies of the cleaning tools are preferably constructed of plastic or relatively stiff rubber to avoid the problem of corrosion. Wing nut fasteners allow the wire mesh screens to be easily removed for replacement or cleaning.

While in the foregoing specification embodiments of the invention have been set forth in considerable detail for purposes of making a complete disclosure thereof, it will be apparent to those skilled in the art that numerous changes may be made in such details without departing from the spirit and principles of the invention.

What is claimed is:

1. A cleaning tool comprising a handle element and a coupled head assembly, the head assembly includes a screen support member, a screen mounted against said support member and means for attaching said screen to said head assembly, said screen having a plurality of abrasive particles attached to said screen, wherein said screen support member comprises a backing plate having a surface with means for locally supporting said screen and displacing said screen from the surface of said backing plate to allow water to flow through the screen during use of the cleaning tool under water.

2. The cleaning tool of claim 1 wherein said means for supporting and displacing said screen comprises a plurality of projecting elements integral with the surface of the backing plate.

3. The cleaning tool of claim 2 wherein said backing plate includes perforations for water flow.

4. The cleaning tool of claim 3 wherein said handle element is hollow and includes means for connecting a water source to said handle for delivering running water to said head assembly.

5. The cleaning tool of claim 1 wherein said head assembly includes further, a top plate coupled to said handle element and connector means for releasably connecting said backing plate to said top plate.

6. The cleaning tool of claim 5 wherein said backing plate has a front and a back and said screen is mounted against the front of said backing plate and in part, peripherally against the back of said backing plate, said means for attaching said screen to said head assembly comprising connector means which clamp said backing plate against said top plate.

7. A cleaning tool comprising a handle element and a coupled head assembly, the head assembly includes a first screen support member, a first screen mounted against said first support member, a second screen support member, a second screen mounted against said second screen support member, and means for attaching said first and second screens to said head assembly, said first and second screens having a plurality of abrasive particles attached to said screens, wherein said head assembly is rotatably connected to said handle element for selective use of said screens.

8. The cleaning tool of claim 7 wherein said screen support members comprise backing plates having surfaces with means for locally supporting said screens and displacing said screens from the surface of said backing plates to allow water to flow through the screen during use of the cleaning tool under water.

9. The cleaning tool of claim 8 wherein said abrasive particles on said second screen are generally larger than on said other screen.

10. A cleaning tool comprising a handle element and a coupled head assembly including a substantially rigid screen support member, a wire mesh screen having a limited degree of flexibility, said screen having a plurality of abrasive particles attached thereto, and means for locally attaching said screen to said support member, said screen support member having means for backing a portion of said screen by displacing said screen from said support member and thus allowing matter to flow through said screen.

* * * * *